US012203487B2

(12) United States Patent
Yamazaki et al.

(10) Patent No.: US 12,203,487 B2
(45) Date of Patent: Jan. 21, 2025

(54) AXIAL FAN

(71) Applicant: SANYO DENKI CO., LTD., Tokyo (JP)

(72) Inventors: Yoshihisa Yamazaki, Tokyo (JP); Masashi Miyazawa, Tokyo (JP)

(73) Assignee: SANYO DENKI CO., LTD., Tokyo (JP)

( * ) Notice: Subject to any disclaimer, the term of this patent is extended or adjusted under 35 U.S.C. 154(b) by 0 days.

(21) Appl. No.: 18/348,409

(22) Filed: Jul. 7, 2023

(65) Prior Publication Data

US 2024/0052853 A1 Feb. 15, 2024

(30) Foreign Application Priority Data

Aug. 12, 2022 (JP) ..... 2022-128680

(51) Int. Cl.

| | |
|---|---|
| ***F04D 29/06*** | (2006.01) |
| ***F04D 19/00*** | (2006.01) |
| ***F04D 25/06*** | (2006.01) |
| ***F04D 29/52*** | (2006.01) |
| ***F04D 29/66*** | (2006.01) |

(52) U.S. Cl.

CPC ..... *F04D 29/668* (2013.01); *F04D 19/002* (2013.01); *F04D 25/0613* (2013.01); *F04D 29/522* (2013.01)

(58) Field of Classification Search

CPC ..... F04D 29/40; F04D 29/403; F04D 29/52; F04D 29/522; F04D 29/66; F04D 29/661; F04D 29/663; F04D 29/665; F04D 29/668; F04D 25/06; F04D 25/0613; F04D 19/002

See application file for complete search history.

(56) References Cited

U.S. PATENT DOCUMENTS

| | | | | |
|---|---|---|---|---|
| 2006/0039784 | A1* | 2/2006 | Yan | F04D 29/544 415/220 |
| 2012/0201670 | A1* | 8/2012 | Takeshita | F04D 29/522 415/212.1 |
| 2012/0230815 | A1* | 9/2012 | Teramoto | F04D 29/023 415/203 |
| 2014/0010636 | A1* | 1/2014 | Hsieh | H02K 5/24 415/119 |
| 2014/0064973 | A1* | 3/2014 | Ren | F04D 29/388 29/889.6 |
| 2014/0186198 | A1* | 7/2014 | Oda | F04D 29/522 417/354 |

FOREIGN PATENT DOCUMENTS

| | | |
|---|---|---|
| JP | 5668534 B2 | 2/2015 |
| JP | 6496773 B2 | 4/2019 |

* cited by examiner

*Primary Examiner* — Elton K Wong

(74) *Attorney, Agent, or Firm* — RANKIN, HILL & CLARK LLP

(57) ABSTRACT

Provided is an axial fan including: an impeller cup including a blade extending in a radial direction; a motor configured to rotate the impeller cup; and a housing accommodating the impeller cup and the motor. The housing includes: a casing portion covering an outer periphery of the impeller cup; a base portion supporting the motor; and a spoke portion connecting the base portion and the casing portion. A vibration restraining portion is provided in a portion, which is connected to the spoke portion, of an outer peripheral portion of the base portion, and the vibration restraining portion has lower stiffness than the other portion of the outer peripheral portion.

2 Claims, 7 Drawing Sheets

AXIAL FAN

CROSS REFERENCES

This application is based on Japanese Patent Application No. 2022-128680 filed with the Japan Patent Office on Aug. 12, 2022, the entire content of which is hereby incorporated by reference.

BACKGROUND

1. Technical Field

The present disclosure relates to an axial fan.

2. Related Art

An axial fan can achieve high cooling performance by increasing the rotational speed of an impeller. However, when the rotational speed of the impeller increases, the solid vibration generated by the axial fan also increases. For example, vibration generated due to the rotation of a rotor is transferred to a casing via a frame including a bearing support portion and a frame hub to generate the vibration of the axial fan.

In order to restrain such vibration, for example, an air-blowing fan disclosed in Japanese Patent No. 5668534 includes an impeller, a motor device, a motor support portion, and a housing that accommodates the impeller and the motor device. The air-blowing fan motor support portion has an approximately circular plate-shaped base portion made of resin. A plurality of recesses recessed in the axial direction is reticulately formed on at least one of the upper surface or lower surface of the base portion. A flat portion of the base portion, excluding the recesses, is configured in such a manner as not to have a portion that is continuous along the radial direction extending radially from the center of the base portion.

An air-blowing fan disclosed in Japanese Patent No. 6496773 includes a rotary shaft, an impeller, a motor, a casing, a motor base portion, and spokes that couple the casing and the motor base portion. The motor base portion of the air-blowing fan has a tubular boss portion, an outer peripheral side surface, and a plurality of reinforcing ribs that couples an outer peripheral side of the boss portion and an outer peripheral side of the motor base portion.

As described above, a plurality of technologies has been proposed to restrain vibration generated with the rotation of blades. However, it cannot be stated unconditionally that vibration restraining is sufficient in either of the air-blowing fans of Japanese Patent No. 5668534 and Japanese Patent No. 6496773. In other words, there is room for further improvement in general air-blowing fans.

Hence, an object of the present disclosure is to provide an axial fan whose vibration can be suppressed.

SUMMARY OF INVENTION

An axial fan according to an embodiment of the present disclosure includes: an impeller cup including a blade extending in a radial direction; a motor configured to rotate the impeller cup; and a housing accommodating the impeller cup and the motor. The housing includes: a casing portion covering an outer periphery of the impeller cup; a base portion supporting the motor; and a spoke portion connecting the base portion and the casing portion. A vibration restraining portion is provided in a portion, which is connected to the spoke portion, of an outer peripheral portion of the base portion, and the vibration restraining portion has lower stiffness than the other portion of the outer peripheral portion.

DETAILED DESCRIPTION

Figure 1:
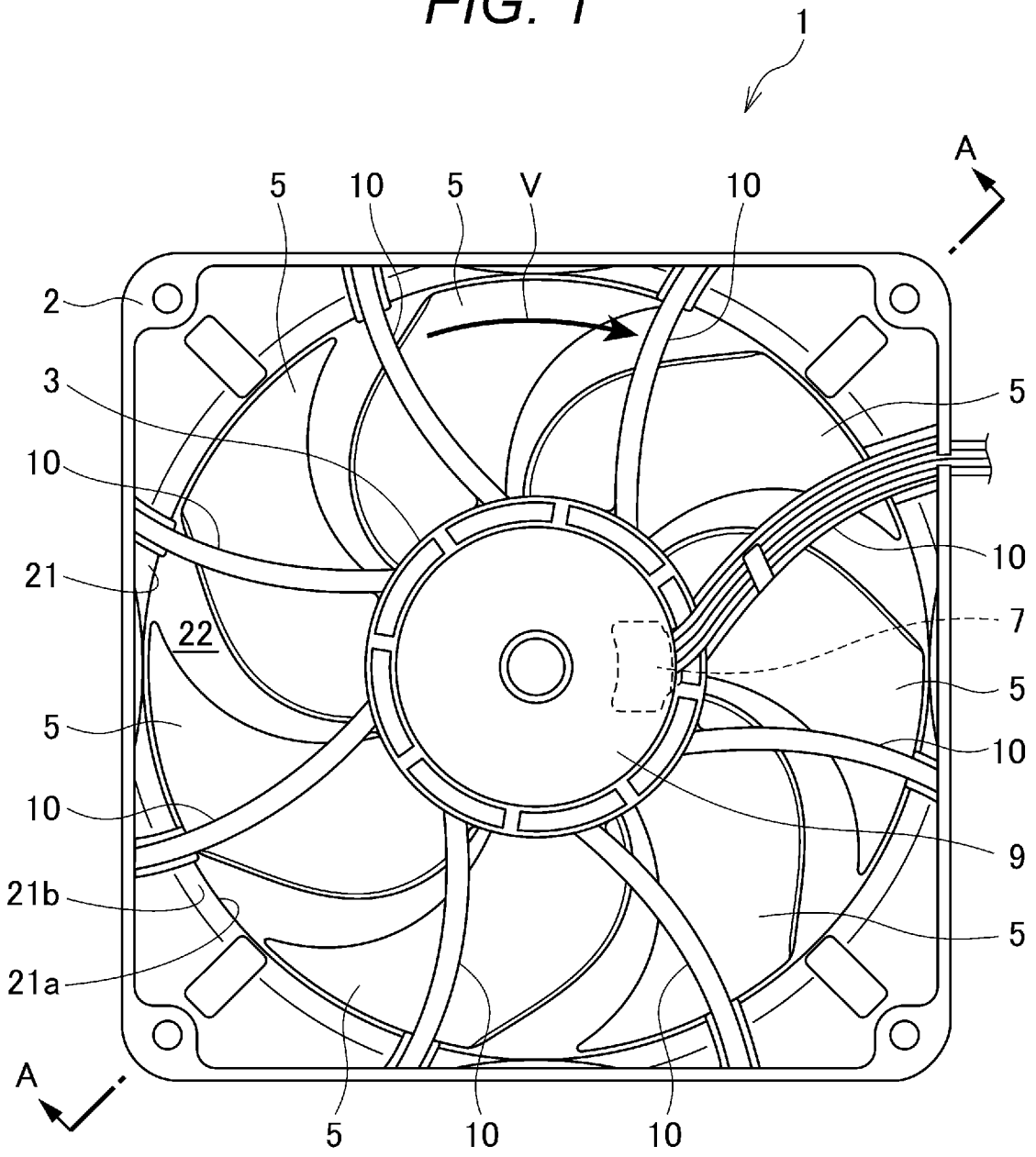
FIG. 1 is a front view of an axial fan according to an embodiment of the present disclosure.

An axial fan according to one aspect of the embodiment includes: an impeller cup including a blade extending in a radial direction; a motor configured to rotate the impeller cup; and a housing accommodating the impeller cup and the motor. The housing includes: a casing portion covering an outer periphery of the impeller cup; a base portion supporting the motor; and a spoke portion connecting the base portion and the casing portion. A vibration restraining portion is provided in a portion, which is connected to the spoke portion, of an outer peripheral portion of the base portion, and the vibration restraining portion has lower stiffness than the other portion of the outer peripheral portion.

An axial fan according to another aspect of the present disclosure includes: an impeller cup including a blade extending in a radial direction; a motor configured to rotate the impeller cup; ana housing accommodating the impeller cup and the motor. The housing includes: a casing portion covering an outer periphery of the impeller cup; a base portion supporting the motor; and a spoke portion connecting the base portion and the casing portion. A vibration bypassing portion is provided at a position spaced away in a circumferential direction from a portion, which is connected to the spoke portion, of an outer peripheral portion of the base portion, and the vibration bypassing portion has higher stiffness than the other portion of the outer peripheral portion.

In the axial fan according to the embodiment, it is possible to provide an axial fan whose vibration can be restrained.

An embodiment of the present disclosure is described hereinafter with reference to the drawings. Note that descriptions of members having the same reference numerals as members that have already been described are omitted in the detailed description for the convenience of description. Moreover, the dimensions of each member illustrated in the drawings may be different from actual dimensions thereof for the convenience of description.

FIG. 1 is a front view illustrating an example of an axial fan according to an embodiment of the present disclosure. As illustrated in FIG. 1, an axial fan 1 includes a housing 2, an impeller cup 3 placed in the housing 2, and a motor 7 that rotationally drives the impeller cup 3. The impeller cup 3 includes a plurality of (seven in this example) blades 5. The motor 7 is accommodated in a cup of the impeller cup 3.

The entire housing 2 is formed in an approximately rectangular shape. The housing 2 includes a cylindrical casing portion 21 that covers the outer periphery of the impeller cup 3, a base portion 9 that supports the motor 7 accommodated in the impeller cup 3, and spoke portions 10 that connect the base portion 9 and the casing portion 21. The housing 2 is made of resin.

The casing portion 21 includes an inlet 21*a* through which wind is drawn in (an opening in the casing portion on the back side in the drawing), and an outlet 21*b* through which the wind that has been drawn in is discharged (an opening in the casing portion on the front side in the drawing). The casing portion 21 defines an airway 22 that communicates with the inlet 21*a* and the outlet 21*b*. With the rotation of the blades 5, the air drawn in through the inlet 21*a* is sent in a direction along the airway 22 (hereinafter referred to as an air-blowing direction W), and discharged to the outside through the outlet 21*b*. FIG. 1 is a diagram of the axial fan 1 as viewed from the outlet 21*b* of the casing portion 21. Note that a direction of an arrow V illustrated in the drawing indicates the rotation direction of the blades 5.

Figure 2:
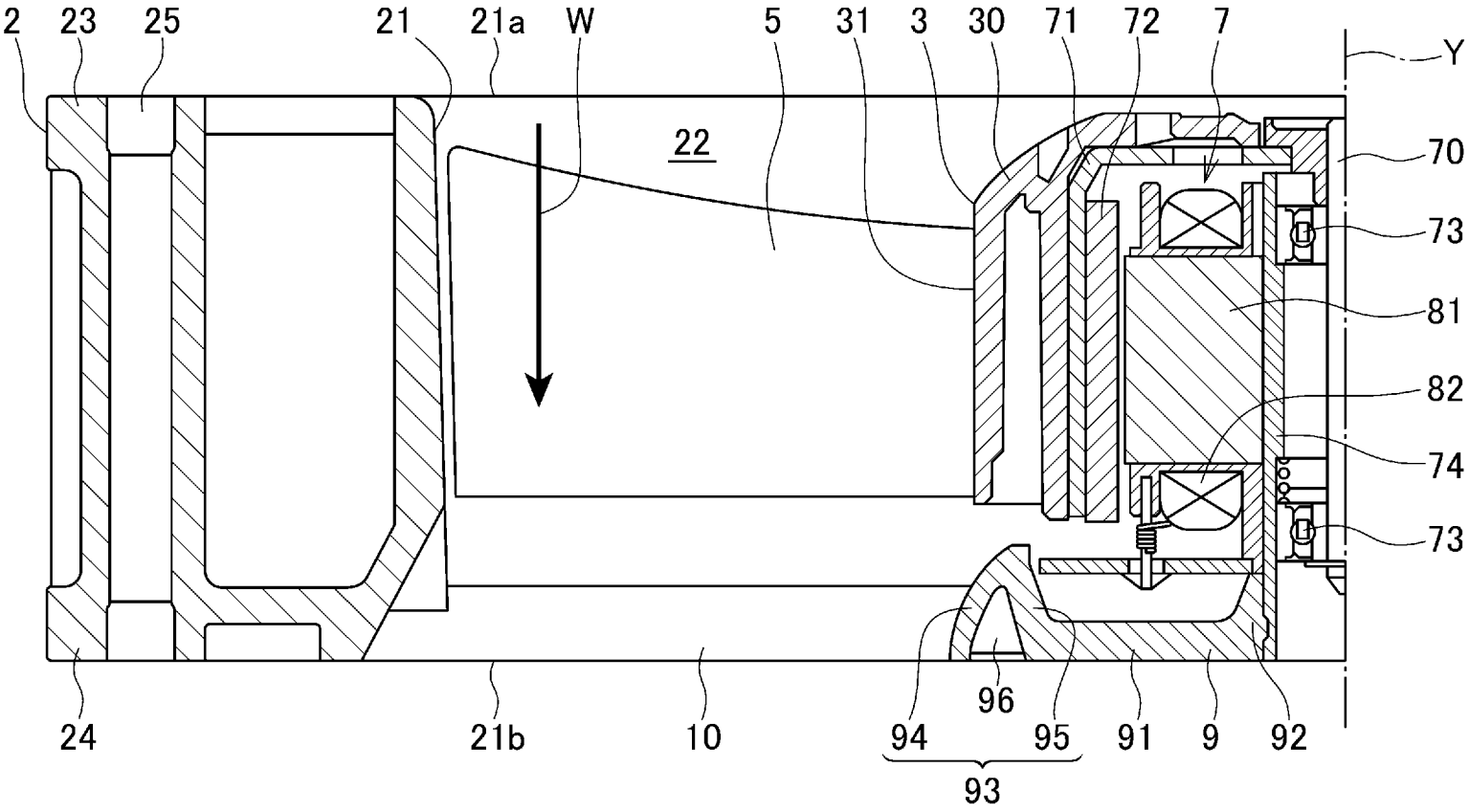
FIG. 2 is a half sectional view taken along line A-A of the axial fan illustrated in FIG. 1.

FIG. 2 is a half sectional view taken along line A-A of the axial fan 1 illustrated in FIG. 1. As illustrated in FIG. 2, a central portion of a cup 30 of the impeller cup 3 is fixed to a rotary shaft 70 of the motor 7. In the following description, a direction along the rotary shaft 70 is referred to as the "axial direction." Moreover, a direction of the radius centered around the rotary shaft 70 is referred to as the "radial direction."

The rotary shaft 70 is provided in a central portion of the airway 22 in such a manner as to be along the airway 22 (the air-blowing direction W). The impeller cup 3 is fixed to the rotary shaft 70 along the airway 22 in such a manner that the opening side of the cup 30 faces in a direction of the outlet 21*b* of the airway 22. An outer peripheral side surface 31 of the cup 30, the outer peripheral side surface 31 being on the outer side in the radial direction, forms an inner peripheral surface on the inlet 21*a* side of the airway 22. The outer peripheral side surface 31 of the cup 30 is formed in such a manner as to extend parallel to the air-blowing direction W. The impeller cup 3 having the blades 5 rotates, together with the rotary shaft 70, in the airway 22. Consequently, the wind is sent in the air-blowing direction W.

The plurality of blades 5 is provided in such a manner as to extend in the radial direction from the outer peripheral side surface 31 of the cup 30. The blades 5 are provided integrally with the cup 30. Each of the plurality of blades 5 is provided in such a manner as to be inclined relative to a direction of the rotary shaft 70.

The motor 7 is accommodated in the cup 30 of the impeller cup 3, as a device that rotationally drives the blades 5. The motor 7 includes an approximately cup-shaped rotor yoke 71, the rotary shaft 70 press-fitted in a central portion of the rotor yoke 71, and a stator core 81 around which a coil 82 is wound.

The rotor yoke 71 is fitted in the cup 30 of the impeller cup 3. The rotor yoke 71 rotates about an axis Y, together with the rotary shaft 70. A magnet 72 is attached to an inner surface of the rotor yoke 71. The rotary shaft 70 is rotatably supported by a bearing 73. The bearing 73 is fixed to an inner surface of a tubular support portion 74. The stator core 81 is fixed to an outer surface of the support portion 74. An outer surface of the stator core 81 faces an inner surface of the magnet 72 of the rotor yoke 71 with a gap therebetween.

Moreover, the stator core 81 of the motor 7 is attached to the base portion 9. The base portion 9 is formed in an approximately cup shape. The base portion 9 is provided on the outlet 21*b* side of the airway 22 in such a manner that the opening side of the base portion 9 faces the opening side of the cup 30 of the impeller cup 3. The base portion 9 is provided in the central portion of the airway 22 in such a manner as to be coaxial with the airway 22.

The base portion 9 includes a motor support portion 91. The motor support portion 91 supports the motor 7 on the downstream side (on the outlet 21*b* side) in the air-blowing direction W. An inner peripheral portion of the motor support portion 91 is provided with an inner peripheral wall portion 92 extending in a direction of the impeller cup 3 along the air-blowing direction W. An outer peripheral portion of the motor support portion 91 is provided with an outer peripheral wall portion 93 extending in the direction of the impeller cup 3 along the air-blowing direction W. The inner peripheral wall portion 92 of the base portion 9 is attached to the stator core 81 of the motor 7, and also fixed to the outer surface of the support portion 74. The outer peripheral wall portion 93 of the base portion 9 forms an inner peripheral surface on the outlet 21*b* side of the airway 22.

The outer peripheral wall portion 93 includes an outer portion 94 located on the outer side in the radial direction, and an inner portion 95 located on the inner side in the radial direction. The outer portion 94 is connected to ends of the spoke portions 10, the ends being on the inner side in the radial direction. The inner portion 95 is connected to the motor support portion 91. In the outer peripheral wall portion 93, an outer end of the wall portion in the radial direction of the motor support portion 91 is bent to form a protruding portion protruding toward the impeller cup 3. The outer peripheral wall portion 93 formed in such a manner as to bend in this manner defines a U- or V-shaped recess 96 that is open toward the downstream side (the outlet 21*b* side) in the air-blowing direction W. In other words, the recess 96 is defined by the outer portion 94 and the inner portion 95.

The spoke portions 10 that couple the base portion 9 and the casing portion 21 are provided on the outlet 21*b* side of the housing 2. A plurality of the spoke portions 10 is provided to the base portion 9 at substantially regular intervals in a circumferential direction of the base portion 9. The base portion 9 and the motor 7 attached to the base portion 9 are supported by the plurality of the spoke portions 10 on the casing portion 21.

An edge of the inlet 21*a* of the casing portion 21 of the housing 2 is provided with a flange portion 23 to fix the housing 2 to, for example, an electronic apparatus. Similarly, an edge of the outlet 21*b* is provided with a flange portion 24. The flange portion 23 is provided, extending outward in the radial direction of the housing 2 from the inlet 21*a*. Similarly, the flange portion 24 is provided, extending outward in the radial direction of the housing 2 from the outlet 21*b*. A fixing hole 25 is formed in the flange portions 23 and 24 in such a manner as to penetrate the housing 2. For example, a screw is inserted into the fixing hole 25. As a result, the axial fan 1 can be attached to, for example, an electronic apparatus.

Figure 3:
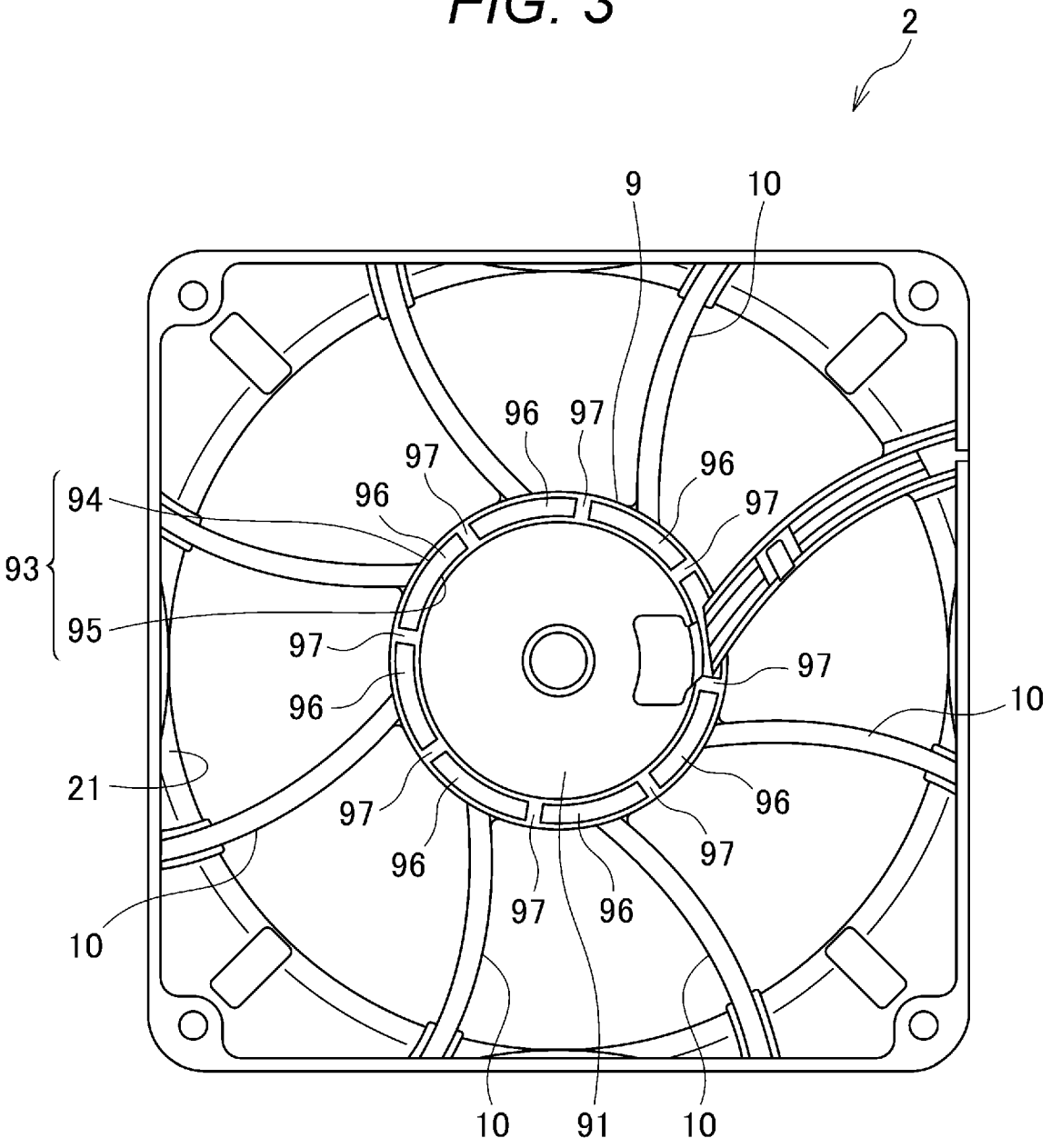
FIG. 3 is a diagram illustrating a housing of the axial fan.

Next, the housing 2 of the axial fan 1 is described in detail with reference to FIG. 3. FIG. 3 is a front view of the housing 2. As illustrated in FIG. 3, the recess 96 is formed by the outer portion 94 and the inner portion 95 in the outer peripheral wall portion 93 of the base portion 9 in such a manner as to be along the circumferential direction of the base portion 9. The recess 96 is a hollow area formed between the outer portion 94 and the inner portion 95.

Moreover, the outer peripheral wall portion 93 of the base portion 9 is provided with connection portions 97 that connect the outer portion 94 and the inner portion 95. The outer portion 94 and the inner portion 95 are connected with resin that buries the recess 96 partially in areas of the connection portions 97. Each of the connection portions 97 is provided between two adjacent recesses 96. The circumferential length (width) and number of the connection portions 97 can be set as appropriate. For example, the length and number of the connection portions 97 may be set according to the frequency of vibration generated.

The spoke portions 10 are connected to the outer portion 94 in areas, in which the recess 96 is formed, of the outer peripheral wall portion 93. Moreover, the connection portions 97 are provided to the outer peripheral wall portion 93 at positions spaced away in the circumferential direction from the positions in each of which the respective spoke portion 10 and the outer portion 94 are connected. In other words, the outer peripheral wall portion 93 is configured in such a manner that the spoke portions 10 are not connected to the outer portion 94 at the positions provided with the connection portions 97.

The portions, in each of which the respective spoke portion 10 is connected to the outer portion 94, of the outer peripheral wall portion 93 have lower stiffness than the other portions of the outer peripheral wall portion 93. For example, the stiffness of the portions, in each of which the respective spoke portion 10 is connected to the outer portion 94, of the outer peripheral wall portion 93 is lower than the stiffness of at least the portions, each of which is provided with the respective connection portion 97, of the outer peripheral wall portion 93. In other words, the stiffness of the outer peripheral wall portion 93 in the portions in the recess 96 is formed is lower than the stiffness of the outer peripheral wall portion 93 at least in the portions each provided with the respective connection portion 97. The hollow areas (the recesses 96) formed between the outer portion 94 and the inner portion 95 are vibration restraining portions with low stiffness that can restrain vibration generated by the operation of the axial fan 1 and vibration generated in, for example, the casing portion 21.

The portions, each of which is provided with the respective connection portion 97, of the outer peripheral wall portion 93 have higher stiffness than the other portions of the outer peripheral wall portion 93. For example, the stiffness of the portions, each of which is provided with the respective connection portion 97, of the outer peripheral wall portion 93 is higher than the stiffness of at least the portions, in each of which the respective spoke portion 10 is connected to the outer portion 94, of the outer peripheral wall portion 93. In other words, the stiffness of the outer peripheral wall portion 93 in the portions each provided with the respective connection portion 97 is higher than the stiffness of the outer peripheral wall portion 93 at least in the portions in which the recess 96 is formed. The areas where the outer portion 94 and the inner portion 95 are connected (the connection portions 97) are vibration bypassing portions with high stiffness that can divert and conduct the vibration generated by the operation of the axial fan 1, and the vibration generated in, for example, the casing portion 21.

Figure 4:
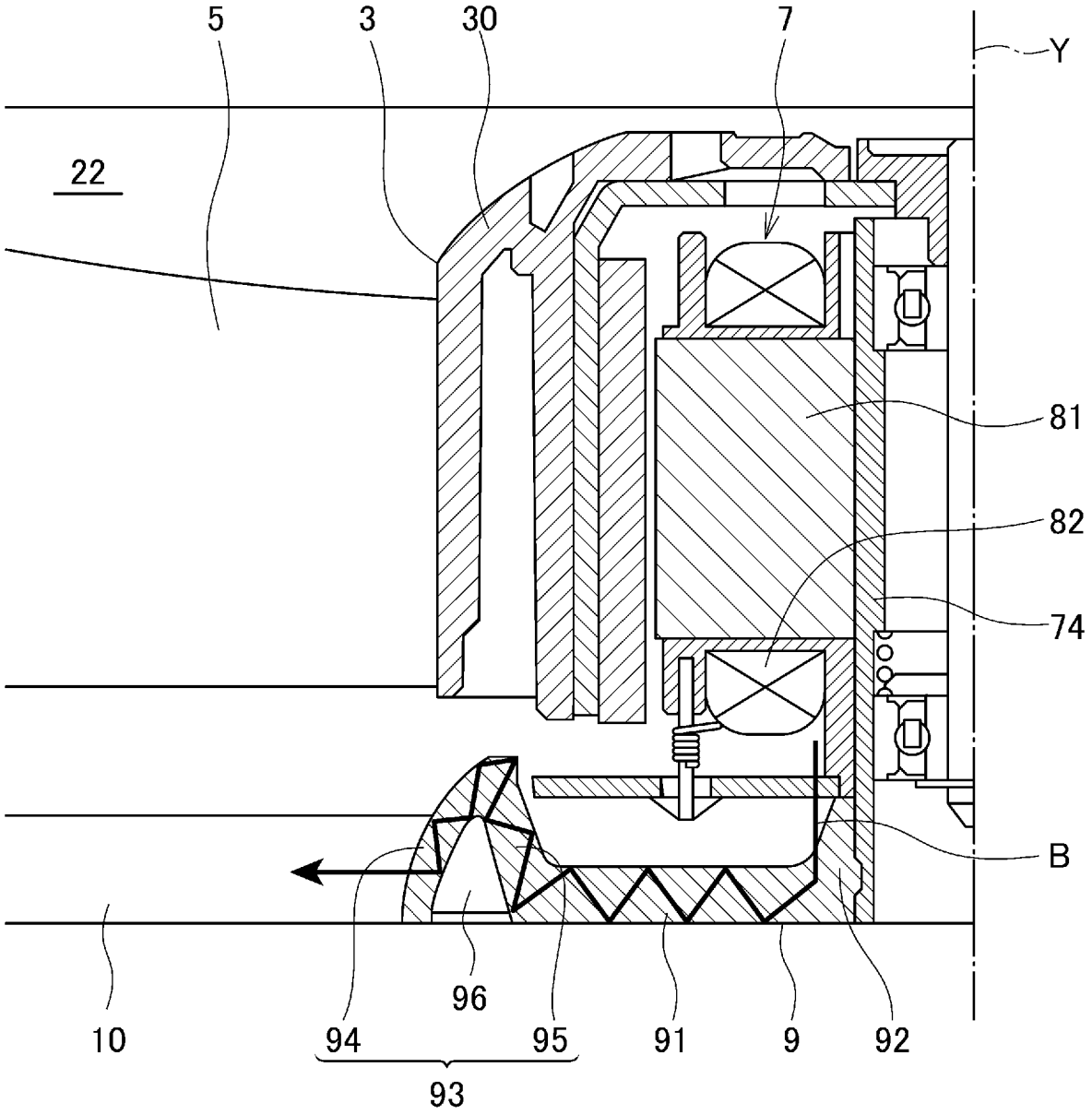
FIG. 4 is a diagram explaining a conduction path of vibration.

FIG. 4 is a diagram explaining a conduction path of the vibration generated by the operation of the axial fan 1. As illustrated in FIG. 4, the vibration generated by the operation of the axial fan 1 in, for example, the motor 7 or the impeller cup 3 is conducted along, for example, a path indicated by an arrow B. Specifically, the vibration generated in the motor 7 or the impeller cup 3 is conducted to the motor support portion 91 from the inner peripheral wall portion 92 of the base portion 9. The vibration is then conducted to the spoke portion 10 via the inner portion 95 and the outer portion 94 of the outer peripheral wall portion 93. In other words, the vibration generated in the motor 7 or the impeller cup 3 is conducted to the spoke portion 10 via the vibration restraining portion with low stiffness formed by the recess 96 between the inner portion 95 and the outer portion 94.

Figure 5:
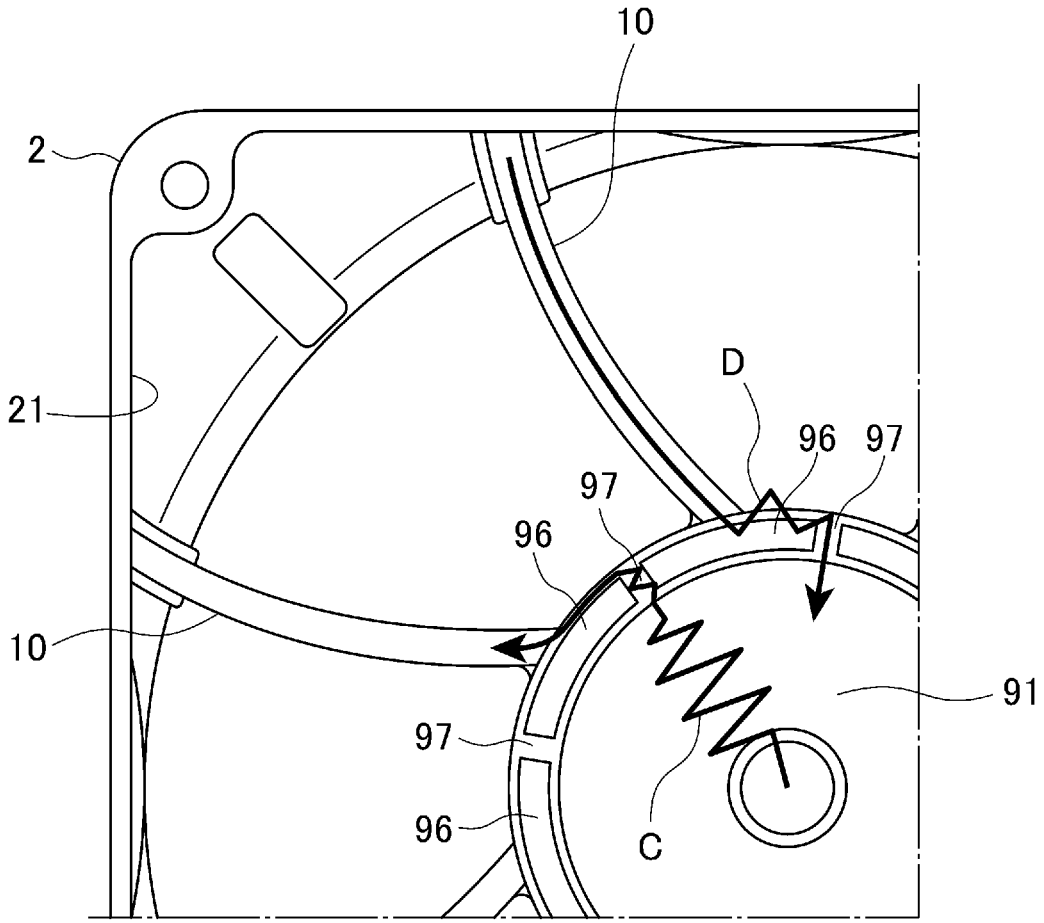
FIG. 5 is a diagram explaining conduction paths of vibration.

FIG. 5 is a diagram explaining conduction paths of the vibration generated by the operation of the axial fan 1 and the vibration generated in, for example, the casing portion 21. As illustrated in FIG. 5, a part of the vibration generated by the operation of the axial fan 1 in the motor 7 or the impeller cup 3 is conducted along, for example, a path indicated by an arrow C. Specifically, the vibration generated in the motor 7 or the impeller cup 3 is conducted to the spoke portion 10 beyond the outer peripheral wall portion 93. At this point in time, a part of the vibration is spread and conducted to the connection portion 97 that has high stiffness and is likely to conduct vibration as in the path of the arrow C illustrated in FIG. 5, in addition to the path of the arrow B illustrated in FIG. 4. In other words, a part of the vibration generated in the motor 7 or the impeller cup 3 is diverted along the path provided with the connection portion 97 with high stiffness and is conducted to the spoke portion 10.

Moreover, as illustrated in FIG. 5, a part of external vibration generated in, for example, the casing portion 21 is conducted along, for example, a path indicated by an arrow D. Specifically, the external vibration generated in, for example, the casing portion 21 is conducted to the motor support portion 91 via the spoke portion 10 beyond the outer peripheral wall portion 93. At this point in time, a part of the vibration is spread and conducted to the connection portion 97 that is more likely to conduct vibration due to high stiffness thereof. In other words, a part of the external vibration generated in, for example, the casing portion 21 is diverted and conducted to the motor support portion 91 along the path provided with the connection portion 97 with high stiffness.

Figure 6:
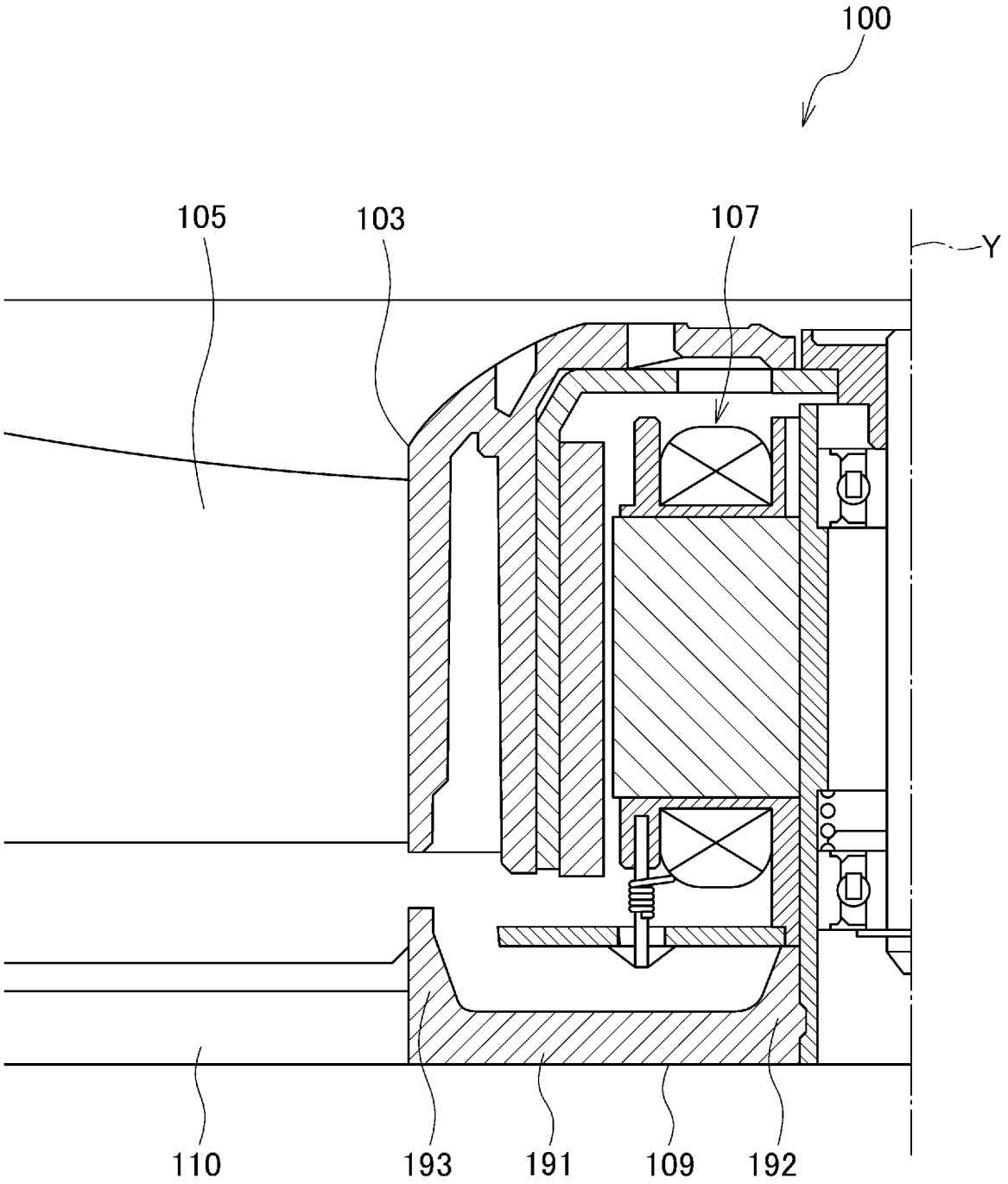
FIG. 6 is a half sectional view illustrating the configuration of an axial fan of a comparative example.

FIG. 6 is a half sectional view illustrating the configuration of an axial fan 100 of a comparative example to compare and study the vibration restraining effects. As illustrated in FIG. 6, the axial fan 100 includes a base portion 109 having a different configuration as compared to the axial fan 1 of the above-mentioned embodiment. Note that the other part of the embodiment, for example, an impeller cup 103 having blades 105, and a motor 107 have configurations similar to those of the impeller cup 3 having the blades 5 and the motor 7 in the axial fan 1 of the embodiment. Hence, the descriptions of the configurations of the impeller cup 103 having the blades 105 and the motor 107 are omitted.

The base portion 109 of the axial fan 100 includes a motor support portion 191. An inner peripheral portion of the motor support portion 191 is provided with an inner peripheral wall portion 192. An outer peripheral portion of the motor support portion 191 is provided with an outer peripheral wall portion 193. The inner peripheral wall portion 192 of the motor support portion 191 has a configuration similar to that of the inner peripheral wall portion 92 of the axial fan 1 of the embodiment. However, the outer peripheral wall portion 193 has a configuration different from that of the outer peripheral wall portion 93 of the axial fan 1. The outer peripheral wall portion 93 of the axial fan 1 of the embodiment is bent in such a manner as to create the recess 96 and forms the outer portion 94 and the inner portion 95. In contrast, the outer peripheral wall portion 193 of the axial fan 100 of the comparative example includes a wall portion formed of one sheet extending substantially vertical in a direction of the impeller cup 103. The outer peripheral wall portion 193 of the axial fan 100 does not include the vibration restraining portion with low stiffness in which the recess 96 is formed. Therefore, the outer peripheral wall portion 193 of the axial fan 100 does not include a member corresponding to the connection portion 97 that connects the outer portion 94 and the inner portion 95 in the axial fan 1 of the embodiment.

Figure 7:
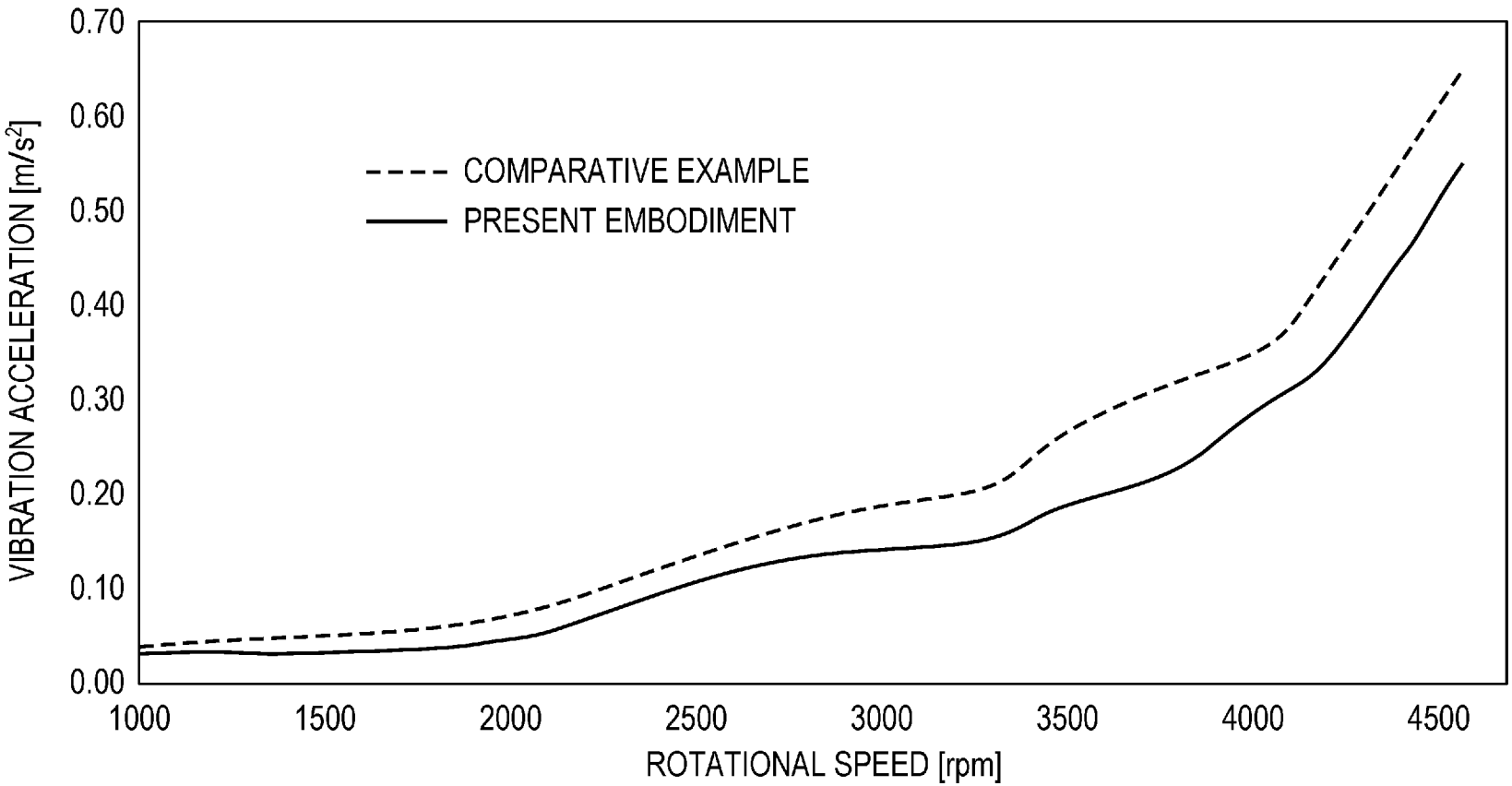
FIG. 7 is a graph illustrating the relationship between rotational speed and vibration acceleration in the axial fan of the embodiment and the axial fan of the comparative example.

FIG. 7 is a graph illustrating the relationship between rotational speed and vibration acceleration in the axial fan 1 of the embodiment and the axial fan 100 of the comparative example. In FIG. 7, the solid line indicates the value of vibration acceleration of the axial fan 1 of the embodiment, and the broken line indicates the value of vibration acceleration of the axial fan 100 of the comparative example.

As illustrated in FIG. 7, the vibration acceleration is reduced in the axial fan 1 of the embodiment that includes the vibration restraining portions with low stiffness in which the recess 96 is formed in the outer peripheral wall portion 93 of the base portion 9, and the vibration bypassing portions with high stiffness, each of which includes the respective connection portion 97, as compared to the axial fan 100 of the comparative example that does not include neither the vibration restraining portion nor the vibration bypassing portion. For example, when the rotational speed of the axial fan is 3000 rpm, the vibration acceleration of the axial fan 100 of the comparative example is 0.19 [$m/s^2$]. In contrast, the vibration acceleration is reduced to 0.14 [$m/s^2$] in the axial fan 1 of the embodiment.

As described above, the axial fan 1 according to the embodiment of the present disclosure includes the outer portion 94 and the inner portion 95 in the outer peripheral wall portion 93 of the base portion 9. The outer peripheral wall portion 93 includes the vibration restraining portions as the portions including the recess 96 defined by the outer portion 94 and the inner portion 95. The vibration restraining portions have lower stiffness than the other portions of the outer peripheral wall portion 93. The base portion 9 is connected to the spoke portions 10 via the vibration restraining portions. The vibration generated by the motor 7 is conducted from the base portion 9 to the casing portion 21 via the spoke portions 10. According to the configuration of the above axial fan 1, the vibration restraining portions with low stiffness are provided to the portions, each of which is connected to the respective spoke portion 10, of the outer peripheral wall portion 93 of the base portion 9. Hence, the vibration generated by the motor 7 can be absorbed by the vibration restraining portions. Therefore, the vibration generated by the motor 7 resists being conducted from the base portion 9 to the spoke portions 10. In this manner, it is possible to reduce the generation of vibration in the axial fan 1.

Moreover, the recess 96 defined by the outer portion 94 and the inner portion 95 of the outer peripheral wall portion 93 of the axial fan 1 is partially provided with the connection portions 97 that connect the outer portion 94 and the inner portion 95. As a result, the vibration bypassing portions with higher stiffness than the portions without the connection portions 97 are formed. In addition, the vibration bypassing portions are placed, spaced away in the circumferential direction from the portions, each of which is connected to the respective spoke portion 10, of the outer peripheral wall portion 93. According to this configuration, a part of the vibration generated by the motor 7 is conducted via the vibration bypassing portion (the connection portion 97) that is likely to conduct vibration due to high stiffness thereof as indicated by, for example, the arrow C of FIG. 5. As a result, it is possible to lengthen the vibration conduction path. Hence, the vibration to be conducted can be dampened. Moreover, also in a case of the external vibration generated in, for example, the casing portion 21, a part of the vibration is conducted to the motor support portion 91 beyond the outer peripheral wall portion 93 via the spoke portion 10 as indicated by, for example, the arrow D of FIG. 5. At this point in time, a part of the vibration is conducted via the vibration bypassing portion (the connection portion 97) that is likely to conduct vibration due to high stiffness thereof. Hence, the vibration conduction path can be lengthened. As a result, the vibration can be dampened.

Up to this point the embodiment of the present disclosure has been described. However, it is needless to say that the technical scope of the embodiment should not be construed in a limited manner by the above-mentioned detailed description. The above-mentioned embodiment is a mere example. Those skilled in the art understand that the embodiment can be modified in various manners within the scope of the disclosure described in the claims. The technical scope of the embodiment should be determined on the basis of the scope of the disclosure described in the claims and the scope of equivalents thereof.

The example in which the stiffness of the outer peripheral wall portion 93 in the portions including the recess 96 is lower than the stiffness of the outer peripheral wall portion 93 in the portions each provided with the respective connection portions 97 is described in the above-mentioned embodiment. However, the embodiment is not limited to this example. For example, the stiffness of the outer peripheral wall portion 93 in the portions including the recess 96 may be lower than the stiffness of the motor support portion 91. Moreover, the example in which the stiffness of the outer peripheral wall portion 93 in the portions each provided with the respective connection portion 97 is higher than the stiffness of the outer peripheral wall portion 93 in the portions including the recess 96 is described in the above-mentioned embodiment. However, the embodiment is not limited to this example. For example, the stiffness of the outer peripheral wall portion 93 in the portions each provided with the respective connection portion 97 may be higher than the stiffness of the motor support portion 91.

Moreover, the example in which the outer peripheral wall portion 93 of the base portion 9 is provided with the recess 96 defined by the outer portion 94 and the inner portion 95, and the connection portions 97 formed between the adjacent recesses 96 is described in the above-mentioned embodiment. However, the configuration of the outer peripheral wall portion 93 is not limited to the above-mentioned embodiment. For example, the outer peripheral wall portion 93 may be simply configured in such a manner that the recess 96 is defined but the connection portions 97 are not provided.

Moreover, as illustrated in FIG. 5, the example in which the vibration bypassing portions (the connection portions 97) have a straight shape and are provided along the radial direction is described in the above-mentioned embodiment. However, the shape and placement orientation of the vibration bypassing portions are not limited to this example. For example, the vibration bypassing portions may have a curved shape. Moreover, the vibration bypassing portions may be placed in such a manner as to be inclined by a predetermined angle relative to the radial direction.

For example, the vibration bypassing portions may be placed, inclined by a predetermined angle relative to the radial direction toward any of the spoke portions 10. This placement enables adjustments in the conduction direction. Hence, it is possible to prevent the increase of a specific vibration frequency to avoid vibration from concentrating on a specific spoke portion 10. Moreover, when the vibration bypassing portions have, for example, a curved shape, a vibration conduction distance in the vibration bypassing portion increases. Hence, vibration can be further dampened.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. An axial fan comprising:

an impeller cup including a blade extending in a radial direction;

a motor configured to rotate the impeller cup; and a housing accommodating the impeller cup and the motor, wherein the housing includes:

a casing portion covering an outer periphery of the impeller cup;

a base portion supporting the motor; and a spoke portion connecting the base portion and the casing portion, a vibration restraining portion is provided in a portion of an outer peripheral portion of the base portion wherein the portion of the outer peripheral portion of the base portion is connected to the spoke portion, a vibration bypassing portion is provided at a position spaced away in a circumferential direction from the portion of the outer peripheral portion of the base portion, the vibration restraining portion has lower stiffness than the vibration bypassing portion, the base portion includes a motor support portion supporting the motor on a downstream side in an air-blowing direction, the outer peripheral portion of the base portion is provided with an outer peripheral wall portion extending along the air-blowing direction, the outer peripheral wall portion includes an outer portion that is located on an outer side in the radial direction and connected to the spoke portion, and an inner portion that is located on an inner side in the radial direction and connected to the motor support portion, a recess is defined by the inner portion and the outer portion, and is open toward the downstream side in the air-blowing direction, the vibration bypassing portion is a connection portion that is disposed in the recess and connects the outer portion and the inner portion, and the vibration restraining portion is a hollow area in the recess.

2. The axial fan according to claim 1, wherein the vibration bypassing portion is inclined by a predetermined angle relative to the radial direction.

* * * * *